US008277941B2

(12) United States Patent
Tanaka et al.

(10) Patent No.: US 8,277,941 B2
(45) Date of Patent: Oct. 2, 2012

(54) ELASTIC POLYURETHANE YARN AND METHOD OF MANUFACTURING THE SAME

(75) Inventors: Toshihiro Tanaka, Otsu (JP); Masashi Hara, Otsu (JP); Tatsuaki Kanbayashi, Otsu (JP)

(73) Assignee: Toray Opelontex Co., Ltd., Tokyo (JP)

( * ) Notice: Subject to any disclaimer, the term of this patent is extended or adjusted under 35 U.S.C. 154(b) by 545 days.

(21) Appl. No.: 12/087,104

(22) PCT Filed: Dec. 26, 2006

(86) PCT No.: PCT/JP2006/325891

§ 371 (c)(1),
(2), (4) Date: Jun. 26, 2008

(87) PCT Pub. No.: WO2007/074814

PCT Pub. Date: Jul. 5, 2007

(65) Prior Publication Data

US 2009/0061716 A1 Mar. 5, 2009

(30) Foreign Application Priority Data

Dec. 27, 2005 (JP) ..... 2005-374023

(51) Int. Cl.
*D02G 3/00* (2006.01)
*D03D 15/00* (2006.01)

(52) U.S. Cl. ..... 428/364; 442/301; 528/45

(58) Field of Classification Search ..... None
See application file for complete search history.

(56) References Cited

U.S. PATENT DOCUMENTS

| | | | | |
|---|---|---|---|---|
| 3,450,675 | A * | 6/1969 | Mercer et al. | 528/72 |
| 4,069,212 | A * | 1/1978 | Fletcher et al. | 528/61 |
| 4,614,785 | A | 9/1986 | Richter et al. | |
| 5,965,627 | A * | 10/1999 | Allcock et al. | 521/137 |
| 2006/0281891 | A1 | 12/2006 | Tsuge et al. | |

FOREIGN PATENT DOCUMENTS

| | | |
|---|---|---|
| EP | 1 112 397 | 1/2004 |
| JP | 10-298188 | 11/1998 |
| JP | 2001-192392 | 7/2001 |
| JP | 2003-82057 | 3/2003 |
| JP | 2005-23478 | 1/2005 |
| WO | 2006/043568 | 4/2006 |

OTHER PUBLICATIONS

Supplementary European Search Report issued May 12, 2009 in European Application No. EP 06 84 3275.
International Search Report issued Feb. 20, 2007 in the International (PCT) Application of which the present application is the U.S. National Stage.

* cited by examiner

*Primary Examiner* — Jenna Johnson
(74) *Attorney, Agent, or Firm* — Wenderoth, Lind & Ponack, L.L.P.

(57) ABSTRACT

The present invention provides elastic polyurethane yarns which possess excellent elongation, recoverability, heat resistance and chemical resistance, as well as a method of manufacturing the same. The elastic polyurethane yarns comprise a polyurethane being composed mainly of a polymeric diol and a diisocyanate, and contains through incorporation a compound having within the molecule a phosphorus-nitrogen interatomic bond(s). The process can produce the elastic polyurethane yarns by adding to a solution of the polyurethane a compound having within the molecule a phosphorus-nitrogen interatomic bond(s), followed by spinning.

10 Claims, No Drawings

ELASTIC POLYURETHANE YARN AND METHOD OF MANUFACTURING THE SAME

This application is a U.S. national stage of International Application No. PCT/JP2006/325891 filed Dec. 26, 2006.

TECHNICAL FIELD

The present invention relates to elastic polyurethane yarns which possess alkali resistance, intensified chemical resistance, high recoverability, high tenacity and high elongation, advanced heat resistance, etc., and also to a method of manufacturing the same.

BACKGROUND ART

Elastic yarns, with their excellent elastic and stretching properties, have been extensively used in the application fields of stretching clothes, such as leg wears, inner wears, sporting wears, etc., as well as the application fields of industrial materials.

With reference to such elastic yarns, among others, there have strongly been demanded the elastic polyurethane yarns which are capable of exhibiting high tenacity and high elongation, high recoverability, intensified chemical resistance, advanced heat resistance, etc. In recent years, especially, intensified chemical resistance is strongly desired and needed for such elastic polyurethane yarns, in cases where they are used as a mixed woven or knitted fabrics in combination with polyester yarns, and there is demanded intensified chemical resistance enough to resist caustic treatment and opal treatment of polyester yarns, namely, the resistance to alkalis, unsaturated fatty acids, quaternary ammonium salts, etc.

As the prior art taking aim to impart the intensified chemical resistance, for example, there has been known the technology which comprises allowing polyvinylidene fluoride to coexist through incorporation in a spinning solution of polyurethanes (refer to the Official Gazette of JP No. 2000-73233 A).

The elastic polyurethane yarns having polyvinylidene fluoride incorporated therein are found to show inadequate recoverability and heat resistance, and find in some instances restricted utilization in the application fields of mixed woven fabrics with polyester yarns where caustic treatment and high-temperature dyeing are required, since they still elicit merely an unsatisfactory level of chemical resistance.

DISCLOSURE OF THE INVENTION

The Problem that the Invention is Intended to Solve

The present invention has as its object to provide the elastic polyurethane yarns which possess alkali resistance, intensified chemical resistance, high recoverability, high tenacity and high elongation, and advanced heat resistance, and a method of manufacturing the same.

The elastic polyurethane yarns of the present invention are ensured by the below-described means provided to attain the above-described objects.

Namely, the elastic polyurethane yarns consist of elastic yarns from a polyurethane composed mainly of a polymeric diol and a diisocyanate, which polyurethane contains a compound having within the molecule a phosphorus-nitrogen interatomic bond(s).

In further particular, the present invention relates to:

(1) An elastic polyurethane made of a polyurethane being composed mainly of a polymeric diol and a diisocyanate, which polyurethane contains through incorporation a compound having within the molecule a phosphorus-nitrogen interatomic bond(s);

(2) The elastic polyurethane yarn as described above under the item (1), characterized in that the compound having within the molecule a phosphorus-nitrogen interatomic bond(s) is contained through incorporation at a content of not less than 0.5% by weight but not more than 50% by weight;

(3) The elastic polyurethane yarn as described above under the item (1) or (2), characterized in that the compound having within the molecule a phosphorus-nitrogen interatomic bond(s) is a compound having within the molecule not less than two phosphorus-nitrogen interatomic bonds;

(4) The elastic polyurethane yarn as described above under any one of the items (1) to (3), characterized in that the compound having within the molecule a phosphorus-nitrogen interatomic bond(s) is a compound showing a molecular weight of not less than 230;

(5) The elastic polyurethane yarn as described above under any one of the items (1) to (4), characterized in that the compound having within the molecule a phosphorus-nitrogen interatomic bond(s) shows a phosphorus content of not less than 5% but not more than 50%;

(6) The elastic polyurethane yarn as described above under any one of the items (1) to (5), characterized in that the compound having within the molecule a phosphorus-nitrogen interatomic bond(s) is a phosphazene;

(7) The elastic polyurethane yarn as described above under any one of the items (1) to (6), characterized in that the compound having within the molecule a phosphorus-nitrogen interatomic bond(s) is a phosphonitrylic acid ester;

(8) The elastic polyurethane yarn as described above under the item (6) or (7), characterized in that the circular-knitted fabric of 5 cm in width made by knitting with sole use of the said elastic polyurethane yarn exhibits the self-extinguishing property when subjected to the horizontal combustion test in accordance with the FMVSS-302 Method as set forth in the Federal Motor Vehicle Safety Standard of the U.S.A.;

(9) A woven or knitted fabric which is made by weaving or knitting with use of the elastic polyurethane yarn as described above under the item (8);

(10) A woven or knitted fabric which is made by weaving or knitting with use of the elastic polyurethane yarn as described above under any one of the items (6) to (8) and which is assessed as fire resistant or flame retardant when subjected to the Combustion Test for Materials for Railway Vehicles of Japan; and

(11) A method of manufacturing an elastic polyurethane yarn, which comprises adding a compound having within the molecule a phosphorus-nitrogen interatomic bond(s) to a solution of a polyurethane composed mainly of a polymeric diol and a diisocyanate, followed by spinning.

Effect of the Invention

The elastic polyurethane yarns of the present invention possess alkali resistance, intensified chemical resistance, high recoverability, high tenacity and high elongation, and advanced heat resistance, and can impart to the clothes made therewith excellent clothing properties in terms of easiness of taking on and off, fitting property, feeling of wearing, resistance to discoloration, appearance-quality or dignity, etc.

The elastic polyurethane yarns of the present invention, in whose embodiments the compound having within the molecule a phosphorus-nitrogen interatomic bond(s) is a phosphazene, can offer the improved fire resistance or flame retardance, in addition to the above-described properties, and can be suitably utilized in the fields in which the flame resistance is required, thus being rendered suited as a material for automobiles and railway vehicles, as well as for aircrafts and ships.

THE BEST MODE FOR CARRYING OUT THE INVENTION

To be described below in more detail is the present invention.

The description is in the first place to be made of the polyurethanes which are usable in the present invention.

The polyurethanes which are usable in the present invention may be any arbitrary ones, only if they are composed mainly of a polymeric diol and a diisocyanate, and are not understood to be particularly limited. Also, their synthetic production processes are not to be particularly restricted.

Thus, the polyurethanes may be polyurethane-ureas which are composed of a polymeric diol and a diisocyanate as well as a low-molecular-weight diamine, and polyurethanes which are composed of a polymeric diol and a diisocyanate as well as a low-molecular-weight diol, while they may be polyurethane-ureas produced by using as a chain extender a compound having within the molecule a hydroxyl and amino group. It is to be noted that glycols and isocyanates of three or more functionalities also are preferably used.

To be described below is the representative structure constituting the polyurethane which is usable in the present invention.

The polymeric diol as a structural unit constituting the polyurethane includes preferably polyether-based glycols, polyester-based glycols, polycarbonate diols, etc. And, it is preferred to use polyether-based glycols from the viewpoint that they can especially impart flexibility and elongation to the resultant yarns.

The polyether-based glycols preferably consist of the copolymerized diol compounds containing a unit represented by the following general formula (I):

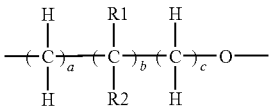

(I)

(wherein a and c each are an integer of 1 to 3; b is an integer of 0 to 3; R1 and R2 each are H or an alkyl group of 1 to 3 carbon atoms).

Specific examples of such polyether-based diols include polyethylene glycols, modified polyethylene glycols, polypropylene glycols, polytrimethylene ether glycols, polytetramethylene ether glycols (hereinafter referred to briefly as "PTMG"), modified PTMGs of copolymers from tetrahydrofuran (hereinafter referred to briefly as "THF") and 3-methyl-THF, modified PTMGs of copolymers from THF and 2,3-dimethyl-THF, modified PTMGs of copolymers from THF and neopentyl glycol, random copolymers consisting of THF, ethylene oxide and/or propylene oxide being polymerized in the irregular arrangement, and the like. These polyether-based glycols may be used either singly, or as after mixing or copolymerization of not less than two kinds thereof. Among others, PTMG and modified PTMGs are preferred.

From the standpoint that the elastic polyurethane yarns are provided with enhanced abrasion resistance and light resistance, meanwhile, preferred use is made of polyester-based glycols, such as polyester diols having side chains obtained by condensation polymerization of butylene adipate, polycaprolactone diol, 3-methyl-1,5-pentanediol or polypropylene polyol solely, or mixtures of not less than two kinds thereof, with adipic acid, etc., polycarbonate diols containing a dicarboxylic-acid ester unit as derived from a dicarboxylic acid component consisting of 3,8-dimethyldecanediacid and/or 3,7-dimethyldecanediacid and a diol component, and the like.

Such polymeric diols may be used singly, or after mixing or copolymerization of not less than two kinds thereof.

The polymeric diols which are usable in the present invention show preferably a number-average molecular weight of 1000 to 8000, more preferably 1800 to 6000, in order to attain the desired levels of elongation, tensile strength, heat resistance, etc. when the resultant polyurethanes are spun into elastic yarn. The polymeric diols with a molecular weight of such ranges, when used in the production of polyurethanes, can yield elastic yarns exhibiting improved elongation, tensile strength or tenacity, elastic recovery strength and heat resistance.

The diisocyanates as another structural unit constituting the polyurethane include, for example, aromatic diisocyanates, such as diphenylmethane diisocyanate (hereinafter referred to briefly as "MDI"), tolylene diisocyanate, 1,4-diisocyanatobenzene, xylylene diisocyanate, 2,6-naphthalene diisocyanate, etc., which diisocyanates are particularly suited for synthesis of the polyurethanes with advanced heat resistance and tensile strength. The alicyclic diisocyanates may preferably be exemplified by methylenebis(cyclohexylisocyanate), isophorone diisocyanate, methylcyclo-hexane-2,4-diisocyanate, methylcyclohexane-2,6-diisocyanate, cyclohexane-1,4-diisocyanate, hexahydroxylylene diisocyanate, hexahydrotolylene diisocyanate, octahydro-1,5-naphthalene diisocyanate, etc. The aliphatic diisocyanates can efficiently be utilized especially for the prevention of yellowing of the resultant elastic polyurethane yarns. And these diisocyanates may be singly or in combination with not less than two kinds thereof.

As the chain extender for the structural units constituting the polyurethanes, use is preferably made of at least one kind out of low-molecular-weight diamines and low-molecular-weight diols. It is to be added that compounds having within the molecule hydroxyl and amine groups, such as ethanolamine, may be usable. Preferred examples of the low-molecular-weight diamines include ethylenediamine, 1,2-propanediamine, 1,3-propanediamine, hexamethylenediamine, p-phenylenediamine, p-xylylenediamine, m-xylylenediamine, p,p'-methylenedianiline, 1,3-cyclohexyldiamine, hexahydro-m-phenylenediamine, 2-methylpentamethylenediamine, bis(4-aminophenyl)phosphine oxide, etc. It is preferred to use one or not less than two kinds out of these diamines. And the most preferable is ethylenediamine, since the compound can yield the yarns exhibiting improved elongation, elastic recoverability and heat resistance. Such chain extenders may be incorporated with triamine compounds capable of forming the crosslinking structure, such as diethylenetriamine, to such an extent as may not lose their effect.

Representative examples of the low-molecular-weight diols include ethylene glycol, 1,3-propanediol, 1,4-butanediol, bishydroxyethoxybenzene, bishydroxyethylene terephthalate, 1-methyl-1,2-ethanediol, etc. It is preferable to use one or not less than two kinds out of these diols. And the most preferred are ethylene glycol, 1,3-propanediol and 1,4-butanediol, since the compounds, when used, can provide the yarns with somewhat enhanced heat resistance and tensile strength as the conventionally known diol chain-extended polyurethanes.

The elastic polyurethane yarns of the present invention, from the viewpoint that they are to be provided with enhanced durability and tensile strength, preferably show a number-average molecular weight in the range of not less than 40000 but not more than 150000, whereby the number-average molecular weight is determined by means of GPC and expressed after being converted to a polystyrene basis.

From the viewpoints that any practical problems inclusive of the problem of processability are to be eliminated, while at the same time, improved heat resistance is to be attained, the particularly preferable polyurethane, which constitutes the elastic polyurethane yarns of the present invention, includes for example the polyurethanes consisting of a diol and a diisocyanate and showing a melting point on the higher-temperature side in the range of not lower than 200° C. but not higher than 300° C., whereby the term "melting point on the higher-temperature side" is understood to be equivalent to the melting point of the so-called hard segment crystal of a polyurethane or polyurethane urea, when determined by DSC.

In other words, the elastic yarns as produced through spinning from a polyurethane, which is synthesized by using as a polymeric diol PTMG with a molecular weight in the range of not less than 1000 but not higher than 6000, MDI as a diisocyanate, and at least one kind as a chain extender being selected from the group consisting of ethylene glycol, 1,3-propanediol, 1,4-butanediol, ethylenediamine, 1,2-propanediamine and 1,3-propanediamine and shows a melting point on the higher-temperature side in the range of not lower than 200° C. but not higher than 300° C., are preferred, since they exhibit particularly enhanced elongation, are in no way confronted with any practical problems inclusive of improved processability and even excel in heat resistance.

As a procedure of maintaining a melting point on the higher-temperature side within the range of not lower than 200° C. but not higher than 300° C., it is preferable to select the optimal value as a mixing ratio of diisocyanate, polymeric diol and chain extender through in-advance or prior testing. The composition or constitution of the polyurethane which is usable in the present invention is preferably typified by such mixing ratio.

The elastic polyurethane yarns of the present invention contain a compound having within the molecule a phosphorus-nitrogen interatmoic bond. The phosphorus-nitrogen interatomic bond in this compound, through its desirable interaction with the urea and urethane groups of the polyurethane in the spinning solution, can prevent the urea and urethane groups from being coagulated, and also can reduce viscosity-variation and gelling, while after being spun into the elastic polyurethane yarns, the bond can cover and protect the crystals composed mainly of the hard segment to thereby permit the elastic yarns to produce the desirable effects, such as intensified chemical resistance, high recoverability and advanced heat resistance. In contrast with this, when the compound having within the molecule a phosphorus-nitrogen bond is not contained in the elastic polyurethane yarns, it is difficult to augment and increase the alkali resistance, resistance to a variety of chemicals, recoverability, tenacity and elongation and heat resistance.

The compound (hereinafter referred to as briefly as "a phosphorus-nitrogen bond containing compound") having within the molecule a phosphorus-nitrogen interatomic bond(s) which is usable in the present invention is understood to refer to any stable compounds that contain within the molecule phosphorus and nitrogen atoms and also have the phosphorus atom(s) bonded directly to the nitrogen atom(s). The compound is not particularly limited, only if it has within one molecule at least one phosphorus-nitrogen interatomic bond. The bond between the phosphorus and the nitrogen atoms in the phosphorus-nitrogen bond containing compound is understood to comprehend all the bonds formed between phosphorus and nitrogen atoms, which bonds show the order of bonding in the range of 1 to 3 and the distance of bond of not less than 0.15 nm, and may bear the ionic character. And the bond between phosphorus and nitrogen atoms are generally expressed as P—N, P═N and P≡N.

The compound having within the molecule a phosphorus-nitrogen interatomic bond(s) may be exemplified by a series of the compounds being referred to as phosphazane, phosphazene or polyphosphazene, and derivatives of phosphoric acid and phosphorus oxo acid, namely dimethylamidophosphoric acid, amidomethylphosphonic acid, hexamethylphosphortriamide, trimethylaminophosphine, melamine phosphates, melamine polyphosphates, guanidine phosphate, guanylurea phosphate, ammonium phosphate, ammonium polyphosphate, piperazine phosphate, etc.

From the viewpoint that the spinning solution of a starting material for the elastic polyurethane yarns is stabilized to secure improved spinning processability, preferred among others are the compounds having within the molecule not less than two phosphorus-nitrogen interatomic bonds, and in order to maintain a higher spinning rate and also suppress reduction in evaporation during spinning, furthermore, the compounds showing a molecular weight of not less than 230 are more preferable. For the purpose of assuring that the resultant elastic polyurethane yarns exhibit efficiently enhanced chemical resistance, recoverability and heat resistance, in addition, it is more preferable that such compounds possess within the molecule much more interatomic bonds between phosphorus and nitrogen atoms. Such compounds preferably show a phosphorus-element content of not less than 5%. In light of the fact that compounds containing the phosphorus element display a limited degree of stability, the content of phosphorus element in such compounds is preferably not more than 50%. From the standpoint of realization of more improved basic physical properties as elastic polyurethane yarns, moreover, such content of phosphorus element preferably ranges from not less than 8% to not more than 42%. It is to be noted that the optimal value for such content should preferably be suitably determined depending upon the intended application field through in-advance or prior testing. Referring to the above-specified compounds, the compounds having the phosphorus-nitrogen double bond are preferred, and are preferably exemplified by phosphazenes and/or their derivatives, with the phosphazene compounds containing a unit represented by the below-illustrated general formula (II) being preferred.

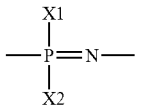

(II)

(wherein X1 and X2 are not restricted and may be any groups).

Specific examples of such phosphazenes include a typical starting compound of phosphonitrile chloride and compounds as derived by a procedure which involves substituting a phosphonitrile chloride for part or the whole of its chlorine atoms with a variety of nucleophilic reagents, such as alcohols, phenols and amines, etc.

Specific examples of X1 and X2 include halogens, such as chlorine, fluorine and bromine, etc., alkyl or aryl groups of 1 to 12 carbon atoms, alkoxy groups, such as methoxy, ethoxy, n-propoxy, iso-propoxy, n-butoxy and iso-butoxy groups, etc., a phenyloxy group, and substituted phenyloxy groups, or aryloxy groups, such as phenyloxy or naphthyloxy groups, which are substituted with ethyl, n-propyl, iso-propyl, tert-butyl, octyl, methoxy, ethoxy and phenyl groups, etc., and an amino group, alkylamino groups, such as methylamino and ethylamino groups, etc., straight-chain or branched dialkylamino groups, such as dimethylamino and diethylamino groups, etc., arylamino groups, a hydroxy group, and the like.

The phosphazene compounds each containing a unit represented by the above-illustrated formula (II) may be polymers formed by subjecting the said unit to repetition, namely polyphosphazenes, and may be in the form of an oligomer or polymer, since the number of repetition is not limited. Furthermore, they may be straight-chain, branched or cyclic. In addition, they may have a crosslinked structure formed by allowing the resultant polymers, or polyphosphazenes, to undergo crosslinking with any arbitrary crosslinking agents.

The phosphazenes or polyphosphazenes, which are particularly preferred in order to produce the elastic polyurethane yarns possessing high recoverability, may more preferably be the compounds of the general formula (II) where X1 and X2 are an alkoxy or aryloxy group, in view of their reactivity with urethane or urea groups, and most preferably includes the compounds of the general formula (II) where X1 and X2 all are esterified, or straight-chain or chained phosphonitrylic acid esters represented by the below-illustrated general formula (III), and cyclic phosphonitrylic acid esters represented by the below-illustrated general formula (IV).

(III)

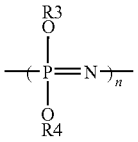

(IV)

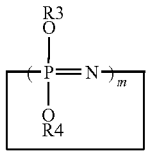

(wherein R3 and R4 are not particularly restricted, and may be any groups; n and m each are an integer of 3 to 1000).

Specific examples of R3 and R4 include alkyl groups of 1 to 12 carbon atoms, allyl group, aryl groups, fluoroalkyl groups, and the like.

More specific examples of chained polymeric and/or cyclic polymeric phosphonitrylic acid esters include hexa(methoxy)triphosphazene, hexa(ethoxy)triphosphazene, hexa(n-propoxy)triphosphazene, octa(iso-propoxy)tetraphosphazene, octa(n-butoxy)tetraphosphazene, hexa(phenoxy)triphosphazene, hexa(p-tolyloxy)triphosphazene, hexa(p-anisyloxy)triphosphazene, hexa(4-ethylphenoxy)triphosphazene, 1,3,5-tris(methoxy)-1,3,5-tris(phenoxy)triphosphazene, hexa(methoxy)cyclotriphosphazene, hexa(ethoxy)cyclotriphosphazene, hexa(n-propoxy)cyclotriphosphazene, octa(iso-propoxy)cyclotetraphosphazene, hexa(phenoxy)cyclotriphosphazene, octa(phenoxy)cyclotetraphosphazene and deca(phenoxy)cyclopentaphosphazene. The above-described phosphonitrylic acid esters can be used singly or as a mixture of not less than two kinds thereof.

The content of the phosphorus-nitrogen bond containing compound in the elastic polyurethane yarns of the present invention is preferably in the range of not less than 0.5% by weight to not more than 50% by weight, from the viewpoint that the improved spinning processability, well-balanced mechanical properties and improved heat resistance are able to be realized, and is more preferably in the range of not less than 1% by weight to not more than 30% by weight, from the standpoint of diminished drops in high tenacity and high elongation of the elastic polyurethane yarns.

Moreover, the phosphorus-nitrogen bond containing compound, which is usable in the present invention, is preferably in the form of a liquid showing a viscosity at 20° C. of not lower than 100 cP but not higher than 10000 P, from the viewpoints that its dispersion and dissolution in a polyurethane shall be accelerated to produce the elastic polyurethane yarns showing the desired physico-chemical properties and an appropriate degree of transparency, as well as a tendency for the phosphorus-nitrogen bond containing compound to maintain its content and to impart resistance to discoloration even after exposure to heat, etc. in the spinning step.

In addition, the polyurethane which is usable in the present invention preferably has one or not less than two kinds of chain terminators incorporated therein. Such chain terminators includes, for example, monoamines, such as dimethylamine, diisopropylamine, ethylmethylamine, diethylamine, methylpropylamine, isopropylmethylamine, diisopropylamine, butylmethylamine, isobutylmethylamine, isopentylmethylamine, dibutylamine, diamylamine, etc., monools, such as ethanol, propanol, butanol, isopropanol, allyl alcohol, cyclopentanol, etc., monoisocyanates, such as phenyl isocyanate, etc., and the like.

Also, the elastic polyurethane yarn and the polyurethane spinning solution may have a variety of stabilizers and pigments incorporated therein. Preferably incorporated in such yarn and solution are, for example, light stabilizers and antioxidants, such as hindered-phenol based chemical agents, inclusive of 2,6-di-t-butyl-p-cresol (BHT) and "Sumilizer GA-80" produced by Sumitomo Chemical Co., benzotriazol-based chemical agents and benzophenone-based chemical agents, such as "Tinuvin" series products produced by Ciba-Geigy Co., phosphorus-based chemical agents, such as "Sumilizer P-16" produced by Sumitomo Chemical Co., a variety of chemical agents based on hindered amines, various pigments, such as iron oxide, titanium oxide, etc., inorganics, such as zinc oxide, cerium oxide, magnesium oxide, carbon black, etc., fluorine-based or silicone-based resin powders, metal soaps, such as magnesium stearate, bacteriocides and deodorants containing silver, zinc or their compounds, lubricants, such as silicone, mineral oils, etc., a variety of antistatic agents, such as barium sulfate, cerium oxide, betaine and phosphoric-acid based compounds, and the like, and it is also preferred to react these compounds with the polyurethanes. In order to augment particularly resistance to light and various nitrogen oxides, it is preferable to use scavengers of nitrogen oxides, such as HN-150 produced by Nippon Hydrazine Co.

Also, fine particles of metal oxides, such as titanium dioxide and zinc oxide, etc. may be added, in view of their greater ease of increasing the spinning rate in the dry spinning process. From the standpoint of advanced heat resistance and functional properties, there may be added inorganic substances and inorganic porous materials (e.g., bamboo charcoal, wood charcoal, carbon black, porous muds, clay, diatomaceous earth, coconut-shell activated carbon, coal-based activated carbon, zeolite, perlite, etc.) to such an extent as may not inhibit the effects of the present invention.

These miscellaneous additives may be added on the occasion of preparing the spinning solution by blending a polyurethane solution with the above-described modifiers, or may be incorporated in advance into the polyurethane solution or dispersion prior to the blending. The content of these additives is suitably determined according to the intended objects, etc.

By virtue of the above-described constitution, the elastic polyurethane yarns according to the present invention are provided with alkali resistance, intensified chemical resistance, high recoverability, high tenacity and high elongation, advanced heat resistance, etc. In the preferred embodiment where the above-described phosphazene compounds are used as a phosphorus-nitrogen bond containing compound, there can be obtained the elastic polyurethane yarns exhibiting fire resistance or flame retardance in addition to such excellent physico-chemical properties.

The fire-resistant or flame-retardant elastic polyurethane yarns heretofore have not been known, and consequently in the application fields where fire resistance or flame retardance is required, ordinarily, elastic polyurethane yarns have been converted into woven or knitted fabrics, followed by fire resistance or flame retardance treatment as a post treatment. Even in the case of woven or knitted fabrics formed with fire-resistant or flame-retardant yarns composed of fire-resistant or flame-retardant polyester yarns used in combination with elastic polyurethane yarns, under current situations, such post-treatment is required. In preferred embodiment of the present invention, however, there can be obtained fire-resistant or flame-retardant elastic polyurethane yarns, without requiring the fire resistance or flame retardance treatment as a post-treatment. Consequently, woven or knitted fabrics formed by their combined use with fire-resistant or flame-retardant polyester yarns can eliminate the need to conduct the fire resistance or flame retardance post-treatment.

Referring to the fire resistance or flame retardance of the elastic polyurethane yarns according to the present invention, it is preferable that a circular knitted fabric of about 5 cm in width being knitted with sole use of elastic polyurethane yarns exhibits self-extinguishing property when subjected to a horizontal combustion test in accordance with the FMVSS-302 Method as set forth in The Federal Motor Vehicle Safety Standard of the U.S.A., and the test procedure is to be described in detail in the below-described Examples.

The phosphazene compounds, which are particularly preferred in order to allow the elastic polyurethane yarns of the present invention to elicit the desired fire resistance or flame retardance, may be exemplified by higher melting-point phosphazene compounds showing a melting point in the range of 100 to 500° C., such as the compounds of the above-illustrated general formula (II) where X1 and X2 each are a phenyloxy or substituted phenyloxy group, and use of such phosphazene compounds can reduce the content of the phosphazene compounds in the elastic polyurethane yarns. Specific examples of the particularly preferred phosphazene include hexa(ethoxy)triphosphazene, hexa(phenoxy)triphosphazene, hexa(ethoxy)cyclotriphosphazene, hexa(methoxy)cyclotriphosphazene, hexa(phenoxy)cyclotriphosphazene, octa(phenoxy)cyclotetraphosphazene, tri(methoxy)tri(phenoxy)cyclotriphosphazene, hexa(naphthyloxy)cyclotriphosphazene, hexa(cyanophenoxy)cyclotriphosphazene, etc.

In order to allow the elastic polyurethane yarns to elicit the fire resistance or flame retardance, the content of the phosphazene compound in the elastic polyurethane yarns is preferably not less than 30% by weight, and is desirably in the range of 5.0 to 20.0% by weight, when taking into consideration the above-mentioned excellent spinning processability and well-balanced mechanical properties.

The elastic polyurethane yarns representing the preferred embodiment of the present invention can be woven or knitted into woven or knitted fabrics, and then can be used in various application fields. In such woven or knitted fabrics, the yarns to be used in combination with said elastic polyurethane yarns are preferably fire-resistant or flame-retardant yarns, and use can be made of, for example, the known fire-resistant or flame-retardant polyester yarns and fire-resistant or flame-retardant nylon yarns. The amount of the above-mentioned elastic polyurethane yarns as used in the above-described woven or knitted fabrics is preferably in the range of 1 to 20% by weight, further preferably in the range of 3 to 15% by weight for the woven fabrics, and is preferably in the range of 5 to 50% by weight for the knitted fabrics.

The form in which the above-mentioned combined use of yarns is effected is not particularly limited, and such yarns can be used, for example, in the form of covered yarns (e.g., single covered yarns, double covered yarns, etc.) formed by providing the elastic polyurethane yarns as a core yarn with coverings.

The woven or knitted fabrics, which are made from the fire-resistant or flame-retardant elastic polyurethane yarns representing the preferred embodiment of the present invention, exhibit adequate fire resistance or flame retardance without requirement of any post-treatments, and can therefore be used in the application fields where the fire resistance or flame retardance is required, such as the interior appliances, furniture, beddings, etc., interior decorative materials for cars or vehicles, aircrafts or ships, and the like. As the said materials for cars or vehicles, for example, there can be provided the woven or knitted fabrics which are assessed as fire resistant or flame retardant in accordance with the Combustion Test for the Materials for Railway Vehicles of Japan, and such fabrics can be utilized as a stretching net or in the fabrication of seats.

In the present invention, the above-mentioned combustion test for the materials for railway vehicles is carried out in accordance with "Combustion Test for the Materials for Railway Vehicles 18-609K" of Japan established and provided for by a corporation aggregate, Japanese Association of Mechanical Technologies for Railway Vehicles.

To be described below in detail is the method of manufacturing the elastic polyurethane yarns of the present invention.

In the present invention, it is preferable to prepare in the first place the polyurethane solution. The method for producing the polyurethane solution, or the polyurethane or the solute in the solution, may be either one of the melt polymerization and solution polymerization methods, and also may be any miscellaneous methods. The solution polymerization method, however, is more preferred. The solution polymerization method can produce the polyurethanes, which contain reduced amounts of contaminants, such as gels, and are easy to be spun, and can facilitate the elastic polyurethane yarns of reduced fineness to be produced. In addition, the solution polymerization method offers the advantage of eliminating the solution-making step.

The polyurethane being particularly suited for the present invention may be exemplified by the polyurethanes, which are synthesized by using as a polymeric diol of PTMG with a molecular weight of not less than 1000 but not more than 6000 and MDI as a diisocyanate, while also utilizing as a chain-extender at least one kind out of ethylene glycol, 1,3-propanediol, 1,4-butanediol, ethylene diamine, 1,2-propanediamine and 1,3-propanediamine, and which show a melting point on the higher temperature side in the range of not lower than 200° C. but not higher than 300° C.

Such polyurethanes can be obtained, for example, through synthesis with use of the above-described starting compounds in dimethylacetamide (referred to briefly as "DMAc"), dimethylformamide (referred to briefly as "DMF"), dimethylsulfoxide (referred to briefly as "DMSO"), N-methyl-2-pyrrolidone (referred to briefly as "NMP"), etc. or solvents composed mainly thereof. Adoptable as a particularly suited method are, for example, the so-called one shot method which involves charging the above-described starting compounds in such a solvent and allowing dissolution, followed by heating for reaction at an appropriate temperature to give such polyurethanes, the method which comprises firstly allowing the polymeric diol and diisocyanate to undergo melt-reaction and then dissolving the reaction product in a solvent, followed by reaction with the above-mentioned polymeric diol to give the polyurethanes.

In cases where a diol is used as a chain extender, the representative procedure of setting the melting point on the higher temperature side of the polyurethane within the range of not lower than 200° C. to not higher than 300° C. includes, for example, the controlling and regulation of the type and ratio of the polymeric diol, MDI and diol. When the polymeric diol shows a lowered molecular weight, for example, a relatively increased ratio of the MDI can yield the polyurethane with a higher melting point on the higher-temperature side. When the diol shows a lowered molecular weight similarly, a relatively decreased ratio of the polymeric diol can provide the polyurethane with a higher melting point on the higher-temperature side. When the polymeric diol shows a molecular weight of not less than 1800, it is preferable to allow the polymerization to proceed with a ratio of (mole number of MDI)/(mole number of the polymeric diol) being maintained at not less than 1.5 so as to increase the melting point on the higher-temperature side up to not lower than 200° C.

In synthesizing such polyurethanes, it is preferred to use catalysts, such as amine-based catalysts and organic metal catalysts, singly or as a mixture of not less than two kinds thereof, as well.

The amine-based catalysts include, for example, N,N-dimethylcyclohexylamine, N,N-dimethylbenzylamine, triethylamine, N-methylmorpholine, N-ethylmorpholine, N,N,N',N'-tetramethylethylenediamine, N,N,N',N'-tetramethyl-1,3-propanediamine, N,N,N',N'-tetramethylhexanediamine, bis-2-dimethylaminoethyl ether, N,N,N',N',N'-pentamethyldiethylenetriamine, tetramethylguanidine, triethylenediamine, N,N'-dimethylpiperazine, N-methyl-N'-dimethylaminoethylpiperazine, N-(2-dimethylaminoethyl) morpholine, 1-methylimidazole, 1,2-dimethylimidazole, N,N-dimethylaminoethanol, N,N,N'-trimethylaminoethylethanolamine, N-methyl-N'-(2-hydroxyethyl)piperazine, 2,4,6-tris(dimethylaminomethyl)phenol, N,N-dimethylaminohexanol, triethanolamine, etc.

The organic metal catalysts may be exemplified by tin octanoate, dibutyltin dilaureate, dibutyl lead octanoate, etc.

Generally, the polyurethane solution obtained in this manner preferably shows a concentration of not less than 30% by weight but not more than 80% by weight.

In the present invention, it is preferable to add the phosphorus-nitrogen bond containing compound to the polyurethane solution. As a procedure of adding the phosphorus-nitrogen bond containing compound to the polyurethane solution, there can be adopted any arbitrary procedures. As the representative procedure, there can be adopted a procedure using a static mixer, a procedure through stirring, a procedure utilizing a homomixer, a procedure employing a two-bar extruder, and the like, whereby from the viewpoint of securing the uniform addition of the compound to the polyurethane solution, it is preferable to add the phosphorus-nitrogen bond containing compound in the form of a solution.

The addition of the phosphorus-nitrogen bond containing compound to the polyurethane solution in some instances brings about the phenomenon that the resultant solution mixture after the addition exhibits an unexpectedly higher level of solution viscosity than the polyurethane solution does before the addition, and in order to prevent such phenomenon, it is preferred to add the chain terminators, singly or as a mixture of not less than two kinds thereof, such as monoamines being exemplified by dimethylamine, diisopropylamine, ethylmethylamine, diethylamine, methylpropylamine, isopropylmethylamine, diisopropylamine, butylmethylamine, isobutylmethylamine, isopentylmethylamine, dibutylamine, diamylamine, etc., monools being exemplified by ethanol, propanol, butanol, isopropanol, allyl alcohol, cyclopentanol, etc., monoisocyanates being exemplified by phenyl isocyanate, etc., and the like.

On the occasion of addition of the phosphorus-nitrogen bond containing compound to the polyurethane solution, there may be simultaneously added the above-described chemical agents and pigments, such as light stabilizers, antioxidants, etc.

The elastic polyurethane yarns of the present invention are not particularly limited in terms of their fineness, filament count, shape of cross-section, etc. For example, the elastic polyurethane yarns may be in the forms of a monofilament composed of single filaments or a multifilament composed of a plural number of single filaments. The shape of cross section of the yarns may be round or flat.

The dry spinning process is not particularly limited, as well, and any arbitrary processes can be adopted.

The speed ratio of the Godets roller to the yarn-winding reel tends to exert influences on the settability and stress decay of the elastic polyurethane yarns of the present invention, and preferably is suitably determined depending upon the intended application purpose of the yarns.

Namely, it is preferable to wind the elastic polyurethane yarns at the speed ratio of the Godets roller to the yarn-winding reel in the range of not less than 1.15 but not more than 1.65 in order to produce the elastic polyurethane yarns exhibiting the improved settability and stress decay. For the purpose of manufacturing the elastic polyurethane yarns exhibiting particularly improved settability and lowered stress decay, the speed ratio of the Godets roller to the yarn-winding reel is preferably set within the range of not less than 1.15 to not more than 1.40, more preferably within the range of not less than 1.15 to not more than 1.35.

In manufacturing the elastic polyurethane yarns exhibiting lowered settability and higher stress decay, it is preferred to wind the elastic polyurethane yarns at the speed ratio of the Godets roller to the yarn-winding reel in the range of not less than 1.25 to not more than 1.65, more preferably in the range of not less than 1.35 to not more than 1.65.

Increases in spinning rate can permit the elastic polyurethane yarns to elicit tenacity, and consequently, the spinning rate set at not lower than 450 m/min is preferred to provide a practically suited level of tenacity. When taking into consideration the industrial-scale production, furthermore, the spinning rate of 450 to 1000 m/min is preferable.

EXAMPLES

The present invention is to be described below in more detail by way of Examples.

Described in the following are the methods for measuring the tenacity, elongation, settability, stress decay, chemical resistance, alkali resistance and heat resistance (heat softening point and melting point):

[Settability, Stress Decay, Tenacity and Elongation]

The settability, stress decay, tenacity and elongation were measured by subjecting the elastic polyurethane yarn to tensile testing with use of Instron Model 4502 Tensile Testing Equipment.

A test specimen of 5 cm in length (L1) was subjected to five-times repetition of 300% elongation at a tensile rate of 50 cm/min, whereby the stress as determined at 300% elongation was made (G1). Then, the test specimen was kept under elongation of 300% for 30 sec, whereby the stress as determined after being kept under such state for 30 sec was made (G2), and was allowed to recover from the elongation, whereby the length of the test specimen as measured when the stress turned to 0 was made (L2). On the occasion of the sixth elongation, furthermore, the test specimen was elongated until it was broken, whereby the stress and length as individually determined and measured at the breaking were made (G3) and (L3), respectively. On the basis of these determinations and measurements, the subject tensile properties were calculated by the following equations:

$$\text{Tenacity}(cN)=(G3)$$

$$\text{Stress decay }(\%)=100\times[(G1)-(G2)]/(G1)$$

$$\text{Settability }(\%)=100\times[(L2)-(L1)]/(L1)$$

$$\text{Elongation }(\%)=100\times[(L3)-(L1)]/(L1)$$

[Chemical Resistance]

A yarn test specimen was fixed under the state of elongation of 100%, followed by three types of exposure treatment as described below: In the first place, the test specimen was treated through immersion in a hexane solution (5% by weight) of oleic acid for 1 hour, then through immersion in an aqueous solution (the chlorine concentration of 500 ppm) of hypochlorous acid for 2 hours, and finally through UV exposure for 2 hours. The UV exposure treatment was conducted in a carbon-arc type Fade-Meter manufactured by Suga Testing Machine Co. employed as a testing equipment under the warm, humid conditions of 63° C. and 60% RH. After the exposure treatment was conducted twice in total, the yarn test specimen was left on standing, while kept stress-free, at room temperature for 24 hours, and the tensile strength at break (G4) was determined by the same method as described above. A ratio (retention ratio) of tensile strength at break (G4) determined after the treatment to tensile strength at break for an untreated yarn (G3) was taken as chemical resistance.

$$\text{Chemical resistance }(\%)=100\times(G4)/(G3)$$

[Alkali Resistance]

As an index of alkali resistance of the elastic polyurethane yarns, there was conducted an alkali treatment assuming the caustic treatment for polyester yarns, and then, a retention ratio of tensile strength at break for the elastic polyurethane yarn was calculated and evaluated.

An elastic polyurethane was fixed under the state of elongation of 100% and placed for sealing in a pressure vessel, which was then filled with an aqueous solution containing a cationic caustic accelerator (DXN-10 produced by Ippoh-sha Co.) and sodium hydroxide (respective contents of 8.0% by weight), followed by treatment at 100° C. for 120 min. The yarn was left on standing, while kept stress-free, at room temperature for 24 hours, followed by determination of tensile strength at break (G5) by the same method as described above. A ratio (retention ratio) of tensile strength (G4) at break determined after the treatment to tensile strength (G3) at break for an untreated yarn was taken as chemical resistance.

$$\text{Alkali resistance }(\%)=100\times(G5)/(G3)$$

[Heat Softening Point]

As an index of the heat resistance of the elastic polyurethane yarns, the heat softening point was measured. An elastic polyurethane was subjected to measurement or determination of a temperature variance for dynamic storage modulus of elasticity E' at a temperature-increasing rate of 10° C./min with use of Equipment for Measuring Dynamic Modulus of Elasticity, RSAII, manufactured by Rheo-Metric Co. The heat softening point was determined from the intersection point at which the tangent on the E' curve in the plateau region of not lower than 80° C. to not higher than 130° C. and the tangent on the E' curve in the region where E' drops owing to thermal softening at not lower than 160° C. meet or cross each other, with E' being plotted on the logarithmic axis and the temperature on the linear axis.

[Melting Point]

As another index of the heat resistance of the elastic polyurethane yarns, the melting point on the higher temperature side, or the melting point of the hard segment crystals, was measured. An elastic polyurethane was subjected to measurement of irreversible flow of heat at a temperature-increasing rate of 3° C./min with use of Model 2920 Modulated DSC manufactured by T.E. Instruments Co., with its peak being taken as a melting point.

Example 1

A DMAC solution (a content of 35% by weight) of a polyurethane polymer (a1) consisting of PTMG with a molecular weight of 2900, MDI and ethylene glycol was prepared to thereby be made the polymer solution A1. As a phosphorus-nitrogen bond containing compound, there was used FP-100 [a mixture b1 composed mainly of hexa(phenoxy)cyclotriphosphazene and octa(phenoxy)cyclotetraphosphazene] produced by Fushimi Seiyakusho Inc. to prepare a DMAc solution thereof. For the purpose of such preparation, a horizontal mill, DYNO-MIL KDL manufactured by WILLY A. BACHOFEN Co., was charged with 85% zirconia beads, which were then allowed to undergo microdispersion at the flow rate of 50 g/min to thereby be made a DMAc solution B1 (a content of 35% by weight) of the phosphorus-nitrogen bond containing compound. As an antioxidant, a solution of the polyurethane ["Metachlor" (registered trademark) 2462, c1, as produced by Du'Pont de Nemours] generated by reaction of t-butyldiethanol amine with methylene-bis-(4-cyclohexylisocyanate) and a polycondensation polymer ["Metachlor" (registered trademark) 2390, c2, as produced by Du'Pont de Nemours] from p-cresol and divinylbenzene were mixed at a ratio of 2:1 (on a weight basis) to prepare a DMAc solution of the antioxidant (a content of 35% by weight), which was made the miscellaneous additive solution C1 (a content of 35% by weight).

The polymer solution A1, the solution B1 of the phosphorus-nitrogen bond containing compound and the miscellaneous additive solution C1 were uniformly mixed at the ratio of 87% by weight, 10% by weight and 3% by weight to thereby be made the spinning solution D1. The spinning solution was subjected to dry spinning and winding at the spinning rate of 540 m/min with the speed ratio of the Godets roller to the yarn winding machine being set at 1.4 to produce a 20-dtex, monofilament elastic polyurethane yarn (200 g of a wound yarn body) with a content of the phosphorus-nitrogen bond containing compound of 10% by weight.

The resultant elastic polyurethane yarn was found to have the composition (% by weight) as shown in Table 1, while the phosphorus-nitrogen bond containing compound was found to show a molecular weight of not less than 694 and a content (found value of elemental analysis) of phosphorus element of 13.4%.

The elastic polyurethane yarn was found to exhibit the elongation at break, tensile strength at break, settability, stress decay, chemical resistance, alkali resistance, heat softening point and melting point as tabulated in Table 2. As may be evident from Table 2, both elongation at break and tensile strength at break showed increases as compared with Comparative Example 1 (to be described below) in which the phosphorus-nitrogen bond containing compound b1 was not formulated, while the settability decreased and the recoverability improved relative to Comparative Example 1; the chemical resistance and alkali resistance rose markedly to two-fold or more levels, respectively, as compared with Comparative Example 1, and the heat softening point and melting point as an index of heat resistance showed improvements as compared with Comparative Example 1.

Additionally, the stretching fabric was fabricated by the below-described procedure to evaluate the appearance and appearance-quality or dignity.

Firstly, the resultant elastic polyurethane yarn was covering-processed. As a yarn for covering, a regular polyester yarn 168 dtex-48 filaments was used and processed, with use of a covering machine, under the conditions of a number of twists=450 t/m and a draft=3.0, to form a covering yarn for wefts. As a yarn for covering, furthermore, a regular polyester yarn 168 dtex-48 filaments was used and processed, with use of a covering machine, under the conditions of a number of twists 700 T/M and a draft=3.5, to form a covering yarn for warps.

Then, warping/weaving was carried out; 5100 warps (1000 rough-winding warped warps) were subjected to sizing/warping, followed by weaving with use of Repier weaving machine to make a 2/1 twill fabric.

Next, dyeing treatment was conducted; the raw fabric produced by weaving was subjected to scouring treatment, intermediate setting treatment (185° C.), alkali caustic treatment (N treatment), embossing treatment (190° C.), dyeing treatment (130° C.), drying, finishing-agent treatment and finishing setting (180° C., fabric feeding-speed of 20 m/min, setting zone of 24 m)), successively.

The resultant stretching fabric was found to be defect-free and to show excellent appearance and appearance-quality or dignity.

Example 2

As a phosphorus-nitrogen bond containing compound, there was used Eypel-F(R) (polyfluoroalkoxyphosphazene, b2) produced by Ethyl Corp. of the USA to prepare a DMAC microdispersion thereof. The preparation was effected by the same procedure as described in Example 1 to thereby be made the DMAc dispersion B2 (a content of 35% by weight) of the phosphorus-nitrogen bond containing compound. The polymer solution A1 as prepared in Example 1, the above-mentioned dispersion solution B2 of the phosphorus-nitrogen bond containing compound, and the miscellaneous additive solution C1 as prepared in Example 1 were uniformly mixed at the ratio of 92% by weight, 5% by weight and 3% by weight to thereby be made the spinning solution D2.

The spinning solution was subjected to dry spinning and winding at a spinning rate of 540 m/min with the speed ratio of the Godets roller to the yarn-winding machine being set at 1.40 to produce a 20 dtex, monofilament-type elastic polyurethane yarn (200 g of a wound yarn body) with a content of the phosphorus-nitrogen bond containing compound of 1% by weight.

The resultant elastic polyurethane yarn was found to have the composition (% by weight) as shown in Table 1, while the phosphorus-nitrogen bond containing compound b2 was found to show a molecular weight of about 100,000 and a content of phosphorus element of 8.5% by weight.

The elastic polyurethane yarn was found to exhibit the elongation at break, tensile strength at break, settability, stress decay, chemical resistance, alkali resistance, heat softening point and melting point as tabulated in Table 2. As may be evident from Table 2, tensile strength at break showed increases as compared with Comparative Example 1 (to be described below), with elongation at break remaining at the equal level, while the settability decreased, namely the recoverability improved relative to Comparative Example 1; the chemical resistance and alkali resistance rose markedly to two-fold or more levels, respectively, as compared with Comparative Example 1, and the heat softening point as an index of heat resistance remained at the level equal to that of Comparative Example 1, and the melting point showed improvements as compared with Comparative Example 1.

Additionally, a stretching fabric was fabricated, and evaluation of the appearance and appearance-quality or dignity demonstrated that the resultant stretching fabric was defect-free and was provided with excellent appearance and appearance-quality or dignity.

Example 3

A DMAc solution (a content of 35% by weight) of a polyurethane urea polymer (a2) consisting of PTMG with a molecular weight of 1800, MDI, ethylenediamine and diethylamine as a chain terminator was prepared through polymerization by the conventional procedure to thereby be made the polymer solution A2. The DMAc solution A2, the solution B1 of the phosphorus-nitrogen bond containing compound as prepared in Example 1 and the miscellaneous additive solution C1 as prepared in Example 1 were uniformly mixed at the ratio of 77% by weight, 20% by weight and 3.0% by weight to thereby be made the spinning solution D3. The spinning solution D3 was subjected to dry spinning and winding at the spinning rate of 600 m/min with the speed ratio of the Godets roller to the yarn-winding machine being set at 1.20 to produce a 20 dtex, 2-filaments multifilament type elastic polyurethane yarn (500 g of a wound yarn body) with a content of the phosphorus-nitrogen bond containing compound of 10% by weight.

The resultant elastic polyurethane yarn was found to have the composition (% by weight) as shown in Table 1.

The elastic polyurethane yarn was found to exhibit the elongation at break, tensile strength at break, settability, stress decay, chemical resistance, alkali resistance, heat softening point and melting point as tabulated in Table 2. As may be evident from the table, both elongation at break and tensile strength at break showed increases as compared with Comparative Example 2 (to be described below) in which B1 was not formulated, while the settability decreased and the recoverability improved relative to Comparative Example 2; the chemical resistance and alkali resistance rose markedly to two-fold and three-fold more levels, respectively, as compared with Comparative Example 2, and the heat softening point as an index of heat resistance increased as compared with Comparative Example 2, while the melting point rose by as high as 10° C. as compared with Comparative Example 2 in which B1 was not formulated.

Additionally, the stretching fabric was fabricated by the same procedure as described in Example 1, and the evaluation demonstrated that the fabric was defect-free and was provided with excellent appearance and appearance-quality or dignity.

Example 4

As a phosphorus-nitrogen bond containing compound, there was used FP-200 (an oligomer of methoxyphenoxycyclophosphazene, b3) under the tradename produced by Fushimi Seiyaku-sho Co. to prepare a DMAc solution thereof. The preparation was effected by the same procedure as described in Example 1 to be made the DMAc solution B3 (a content of 35% by weight) of the compound having within the molecule a phosphorus-nitrogen bond. The polymer solution A2 as prepared in Example 3, the above-mentioned solution B3 of the phosphorus-nitrogen bond containing compound, and the miscellaneous additive solution C1 as prepared in Example 1 were uniformly mixed at the ratio of 87% by weight, 10% by weight and 3.0% by weight to thereby be made the spinning solution D4. The spinning solution D4 was subjected to dry spinning and winding at a spinning rate of 600 m/min with the speed ratio of the Godets roller to the yarn-winding machine being set at 1.30 to produce a 20 dtex, 2-filaments multifilament-type elastic polyurethane yarn (500 g of a wound yarn body) with a content of the phosphorus-nitrogen bond containing compound of 35% by weight.

The resultant elastic polyurethane yarn was found to have the composition (% by weight) as shown in Table 1, while the phosphorus-nitrogen bond containing compound b3 was found to show a molecular weight of not less than 507 and a content of phosphorus element of 18.3%.

The elastic polyurethane yarn was found to exhibit the elongation at break, tensile strength at break, settability, stress decay, hot-water resistance, heat softening point and chemical resistance as tabulated in Table 2. As may be evident from the table, the chemical resistance rose to a 2.5-fold level, as compared with Comparative Example 2 in which B3 was not formulated, and the elongation at break increased markedly, as compared with Comparative Example 2 in which B3 was not formulated; the settability and stress decay as an index of recoverability, as well as the hot-water resistance and heat softening point as an index of heat resistance showed levels equivalent to or more than those found with Comparative Example 1 in which B1 was not formulated.

Additionally, a stretching fabric was fabricated, and the evaluation of the appearance and appearance-quality or dignity demonstrated that the resultant stretching fabric was defect-free and was provided with excellent appearance and appearance-quality or dignity.

The elastic polyurethane yarn was found to exhibit the elongation at break, tensile strength at break, settability, stress decay, chemical resistance, alkali resistance, heat softening point and melting point as tabulated in Table 2; the tensile strength at break and elongation at break increased, as compared with Comparative Example 2 (to be described below) in which B3 was not formulated, while the settability decreased as compared with Comparative Example 2, and the recoverability improved; the chemical resistance and alkali resistance rose markedly up to 2-fold or more levels, respectively, as compared with Comparative Example 2. The heat softening point and melting point as an index of heat resistance showed increases, respectively, as compared with Comparative Example 2 in which B3 was not formulated.

Additionally, a stretching fabric was fabricated by the same procedure as described in Example 1, and the evaluation of the appearance and appearance-quality or dignity demonstrated that the resultant stretching fabric was defect-free and was provided with excellent appearance and appearance-quality or dignity.

Comparative Example 1

The polymer solution A1 as prepared in Example 1 and the miscellaneous additive solution C1 as prepared in Example 1 were uniformly mixed at the ratio of 97% by weight and 3% by weight to thereby be made the spinning solution E1. The spinning solution E1 was subjected to dry spinning and winding at a spinning rate of 540 m/min with the speed ratio of the Godets roller to the yarn-winding machine being set at 1.40 to produce a 20 dtex, monofilament-type elastic polyurethane yarn.

The resultant elastic polyurethane yarn was found to exhibit the elongation at break, tensile strength at break, settability, stress decay, chemical resistance, alkali resistance, heat softening point and melting point as tabulated in Table 2. As may be evident from the table, the chemical resistance and alkali resistance showed outstanding deterioration as compared with Examples 1 and 2, in both of which the phosphorus-nitrogen bond containing compound was formulated.

Additionally, the stretching fabric was fabricated by the same procedure as described in Example 1, and the evaluation of appearance and appearance-quality or dignity demonstrated that the fabric suffered from partial puckering owing to the weaken of the elastic polyurethane yarns as caused by the history of processes, with the average number of such undulations amounting up to 15 spots per length of 20 m, and was merely provided with unsatisfactory appearance.

Comparative Example 2

The polymer solution A2 as prepared in Example 3 and the miscellaneous additive solution C1 as prepared in Example 1 were uniformly mixed at the ratio of 97% by weight and 3% by weight to thereby be made the spinning solution E2. The spinning solution E2 was subjected to dry spinning and winding at a spinning rate of 600 m/min with the speed ratio of the Godets roller to the yarn-winding machine being set at 1.20 to produce a 20 dtex, 2-filaments multifilament-type elastic polyurethane yarn (a wound yarn body of 500 g).

The resultant elastic polyurethane yarn was found to exhibit the elongation at break, tensile strength at break, settability, stress decay, chemical resistance, alkali resistance, heat softening point and melting point as tabulated in Table 2. As may be evident from the table, the chemical resistance and alkali resistance showed outstanding deterioration, as compared with Examples 3 and 4, in both of which the phosphorus-nitrogen bond containing compound was formulated.

Additionally, the stretching fabric was fabricated by the same procedure as described in Example 1, and the evaluation of appearance and appearance-quality or dignity demonstrated that the fabric suffered from partial puckering owing to the weaken of the elastic polyurethane yarns being caused by the history of processes, with the average number of such undulations amounting up to 4 spots per length of 20 m, and was merely provided with unsatisfactory appearance.

Comparative Example 3

A DMAc solution F1 (a content of 35% by weight) of the polyvinylidene fluoride (with a number-average molecular weight of 48,000, f1) produced by Kureha Chemical Ind., Co. and as described in the Official Gazette of JP No. 2000-73233 A was prepared. The preparation was in accordance with the procedure as described in Example 1.

The polymer solution A2 as prepared in Example 3, the above-described polyvinylidene-fluoride solution F1 and the miscellaneous additive solution C1 as prepared in Example 1 were uniformly mixed at the ratio of 92% by weight, 5% by weight and 3.0% by weight to thereby be made the spinning solution E3. The spinning solution E3 was subjected to dry spinning and winding at a spinning rate of 600 m/min with the speed ratio of the Godets roller to the yarn-winding machine being set at 1.30 to produce a 20 dtex, 2-filaments multifilament-type elastic polyurethane yarn (500 g of a wound yarn body).

The resultant elastic polyurethane yarn was found to exhibit the elongation at break, tensile strength at break, settability, stress decay, hot-water resistance, heat softening point and chemical resistance as tabulated in Table 2. As may be evident from the table, the chemical resistance rose up to a 1.5-fold higher level than the ones found in Comparative Example 2, in which the polyvinylidene fluoride was not admixed, but was inferior to the ones found in Example 3 and 4, while the settability was too big.

Additionally, the stretching fabric was fabricated by the same procedure as described in Example 1, and the evaluation of appearance and appearance-quality or dignity demonstrated that the fabric suffered from overall puckering owing to the weaken of the elastic polyurethane yarns being caused by increased settability, and was merely provided with unsatisfactory appearance.

Comparative Example 4

A DMAC dispersion (a content of 35% by weight) of TPP (triphenylphosphate) produced by Daihachi Chemical Co. was prepared. The preparation was in accordance with the same procedure as described in Example 1. The polymer solution A2 as prepared in Example 3, the above-described TPP dispersion F2 and the miscellaneous additive solution C1 as prepared in Example 1 were uniformly mixed at the ratio of 87% by weight, 10% by weight and 3.0% by weight to be made the spinning solution E4. The spinning solution E4 was subjected to dry spinning and winding at a spinning rate of 600 m/min with the speed ratio of the Godets roller to the yarn-winding machine being set at 1.30 to produce a 20 dtex, 2-filaments multifilament-type elastic polyurethane yarn (500 g of a wound yarn body).

The resultant elastic polyurethane yarn was found to exhibit the elongation at break, tensile strength at break, settability, stress decay, chemical resistance, alkali resistance, heat softening point and melting point as tabulated in Table 2. As may be evident from the table, the elongation at break, tensile strength at break, settability, chemical resistance and alkali resistance were equal or inferior to the ones found in Comparative Example 2, in which TTP was not admixed, and were markedly inferior to the ones in Examples 3 and 4.

Additionally, the stretching fabric was fabricated by the same procedure as described in Example 1, and the evaluation of appearance and appearance-quality or dignity demonstrated that the fabric suffered from overall puckering and also developed the white-colored bleedings being assumed to be caused by TPP everywhere after elapse of 2 months, being merely provided with unsatisfactory appearance.

Table 1 tabulates the compositions (% by weight) of the elastic polyurethane yarns as produced in the above described Examples 1 to 4 and Comparative Examples 1 to 4, while Table 2 presents as tabulated the elongation at break, tensile strength at break, settability, stress decay, chemical resistance, alkali resistance, heat softening point and melting point.

TABLE 1

| | Polyurethane (% by wt.) | | P—N bond contng. cmpd. (% by wt.) | | | Miscellaneous Additives (% by wt.) | | | |
|---|---|---|---|---|---|---|---|---|---|
| Example No. | a1 A[1)] | a2 AA[1)] | b1 B[2)] | b2 BB[2)] | b3 BBB[2)] | c1 C[3)] | c2 CC[3)] | f1 or f2 CCC[3)] | Total (% by wt.) |
| Ex. 1 | 87 | 0 | 10 | 0 | 0 | 2 | 1 | 0 | 100 |
| Ex. 2 | 92 | 0 | 0 | 5 | 0 | 2 | 1 | 0 | 100 |
| Ex. 3 | 0 | 77 | 20 | 0 | 0 | 2 | 1 | 0 | 100 |
| Ex. 4 | 0 | 87 | 0 | 0 | 10 | 2 | 1 | 0 | 100 |
| Comp. Ex. 1 | 97 | 0 | 0 | 0 | 0 | 2 | 1 | 0 | 100 |
| Comp. Ex. 2 | 0 | 97 | 0 | 0 | 0 | 2 | 1 | 0 | 100 |
| Comp. Ex. 3 | 0 | 92 | 0 | 0 | 0 | 2 | 1 | 5 | 100 |
| Comp. Ex. 4 | 0 | 87 | 0 | 0 | 0 | 2 | 1 | 10 | 100 |

Remarks:

[1)]A and AA denote the polyurethane polymer and polyurethane urea polymer, respectively.

[2)]B, BB and BBB denote the mixture composed mainly of hexa(phenoxy)cyclotriphosphazene and octa (phenoxy)-cyclotetraphosphazene, polyfluoroalkoxyphosphazene, and oligomer of methoxyphenoxycyclophosphazene, respectively.

[3)]C, CC and CCC denote the polyurethane generated by reacting t-butyldiethanolamine with methylene-bis-(4-cyclohexyl-isocyanate), polycondensation polymer from p-cresol and divinylbenzene, and polyvinylidene fluoride (Comparative Example 3) or TPP (Comparative Example 4), respectively.

TABLE 2

| | Elongation(%) | Tenacity (cN) | Settability (%) | Stress Decay (%) | Alkali resistance(%) | Chemical resistance(%) | m.p. (° C.) | Heat softeng. pt.(° C.) |
|---|---|---|---|---|---|---|---|---|
| Ex. 1 | 420 | 22 | 20 | 34 | 85 | 82 | 182 | 230 |
| Ex. 2 | 400 | 25 | 22 | 34 | 72 | 70 | 180 | 225 |
| Ex. 3 | 540 | 31 | 15 | 29 | 80 | 90 | 212 | 275 |
| Ex. 4 | 500 | 28 | 14 | 28 | 75 | 92 | 210 | 268 |
| Comp. Ex. 1 | 400 | 21 | 25 | 35 | 35 | 35 | 180 | 225 |
| Comp. Ex. 2 | 490 | 25 | 18 | 28 | 29 | 30 | 205 | 265 |
| Comp. Ex. 3 | 510 | 28 | 35 | 30 | 45 | 39 | 195 | 254 |
| Comp. Ex. 4 | 460 | 20 | 25 | 30 | 29 | 23 | 199 | 240 |

The elastic polyurethane yarns as produced in the above-described Examples and Comparative Examples were evaluated for their respective fire resistance or flame retardance in accordance with the below-described method, with the results being presented in Table 3.

[Method of Evaluating the Fire Resistance or Flame Retardance]

A yarn (40 dtex) made by drawing out two elastic polyurethane yarns (20 dtex) was fed into a single feeder circular knitting machine having 320 needles fitted and a knit diameter of 3.5 inches (29 gauges) to effect knitting, followed by steam-setting at 120° C. for 1 min. to give a circular knitted fabric of ca. 5 cm in width (55 g/m$^2$). The fabric without being cut and open width was used as a test specimen (equivalent to two knitted fabrics of 55 g/m$^2$ as put each on the other) and subjected to three-times repeated horizontal combustion tests in accordance with the FMVSS-302 Method as set forth in the Federal Automobile Safety Standard of the U.S.A., to measure the combustion distances prior to the bench mark, combustion distances posterior to the bench mark and lengths of time required for combustion prior to the bench mark.

The distance prior to the bench mark was set at 38 mm, and the test specimen, when its combustion distance posterior to the bench mark was found to be 0, was assessed as "self-extinguishing".

TABLE 3

| | | A[1)] | B[2)] | C[3)] | D[4)] | Assessment |
|---|---|---|---|---|---|---|
| Ex. 1 | 1st | 17 | 0 | 0 | 0 | Self-extinguishing |
| | 2nd | 20 | 0 | 0 | 0 | Self-extinguishing |
| | 3rd | 18 | 0 | 0 | 0 | Self-extinguishing |
| Ex. 2 | 1st | 18 | 0 | 0 | 0 | Self-extinguishing |
| | 2nd | 28 | 0 | 0 | 0 | Self-extinguishing |
| | 3rd | 28 | 0 | 0 | 0 | Self-extinguishing |
| Ex. 3 | 1st | 14 | 0 | 0 | 0 | Self-extinguishing |
| | 2nd | 15 | 0 | 0 | 0 | Self-extinguishing |
| | 3rd | 21 | 0 | 0 | 0 | Self-extinguishing |
| Ex. 4 | 1st | 20 | 0 | 0 | 0 | Self-extinguishing |
| | 2nd | 14 | 0 | 0 | 0 | Self-extinguishing |
| | 3rd | 20 | 0 | 0 | 0 | Self-extinguishing |
| Comp. | 1st | 38 | 254 | 22 | 692.7 | Easily inflammable |
| Ex. 1 | 2nd | 38 | 254 | 24 | 635.0 | Easily inflammable |
| | 3rd | 38 | 254 | 25 | 609.6 | Easily inflammable |
| Comp. | 1st | 38 | 254 | 26 | 586.2 | Easily inflammable |
| Ex. 2 | 2nd | 38 | 254 | 28 | 544.3 | Easily inflammable |
| | 3rd | 38 | 254 | 24 | 635.0 | Easily inflammable |
| Comp. | 1st | 38 | 254 | 29 | 525.5 | Easily inflammable |
| Ex. 3 | 2nd | 38 | 254 | 24 | 635.0 | Easily inflammable |
| | 3rd | 38 | 80 | 16 | 300.0 | Easily inflammable |

TABLE 3-continued

| | | A[1)] | B[2)] | C[3)] | D[4)] | Assessment |
|---|---|---|---|---|---|---|
| Comp. | 1st | 38 | 254 | 22 | 692.7 | Easily inflammable |
| Ex. 4 | 2nd | 38 | 254 | 28 | 544.3 | Easily inflammable |
| | 3rd | 38 | 254 | 28 | 544.3 | Easily inflammable |

Remarks:
[1)]The combustion distance prior to the bench mark, (mm)
[2)]The combustion distance posterior to the bench mark, (mm)
[3)]The length of time required for combustion prior to the bench mark, (sec)
[4)]The rate of combustion posterior to the bench mark, (mm/min)

From the results presented above in Table 3, the elastic polyurethane yarns containing phosphazene, as produced in Examples 1 to 4, showed individually not more than 38 mm in the combustion distance prior to the bench mark and consequently were judged as 0 in the combustion distance posterior to the bench mark, thus being assessed as self-extinguishing.

On the other hand, all of the elastic polyurethane yarns as produced in Comparative Examples were assessed as easily inflammable.

With use of the elastic polyurethane yarns as produced in the above-mentioned Examples and Comparative Examples, furthermore, (two-way) stretching fabrics were fabricated and subjected to the Combustion Test for the Materials for Railway Vehicles in accordance with "Combustion Test for the Materials for Railway Vehicles 18-609K" established and set forth by a corporation aggregate, Japanese Association of Mechanical Technologies for Railway Vehicles.

The fabrics as used in the test were fabricated by the below-described procedure.

A multi-end filament (100 dtex) was made by drawing out 5 elastic polyurethane yarns, as produced individually in Examples and Comparative Examples. As a weft, a double-covered yarn was made by providing above-mentioned multi-end yarn with a covering consisting of fire-resistant or flame-retardant polyester yarns (90 dtex-48 filaments) (the covering conditions: number of twists=400 T/M, draft=3.0), while as a warp, a double-covered yarn was made by providing the above-described multi-end yarn with a covering consisting of a fire-resistant or flame-retardant polyester yarn (150 dtex-48 fil) (the covering processing conditions: number of twists 600 T/M, draft=3.5). Using such wefts and warps, weaving was performed in the 2/1 twill elastic woven by the Repier weaving machine (90 warps/inch; 106 wefts/inch), and the resultant fabric was press-set at 180° C. by the conventional procedure to give a stretching fabric (12% by weight of an elastic polyurethane content; 88% of a fire-resistant or flame-retardant polyester yarn content). These fabrics were used as a test specimen in the above-described tests.

The test specimens were subjected to the Combustion Test for the Materials for Railway Vehicles, as carried out in the above-mentioned manner, thus demonstrating that all of the fabrics made with use of the elastic polyurethane yarns as produced in Examples 1 to 4 were assessed as self-extinguishing, whereas the ones with use of the elastic polyurethane yarns as produced in Comparative Examples 1 to 4 were all assessed as easily inflammable.

INDUSTRIAL APPLICABILITY

The elastic polyurethane yarns according to the present invention possess alkali resistance, intensified chemical resistance, high recoverability, high tenacity and high elongation, advanced heat resistance, etc., and the fabrics, etc. made of such elastic yarns exhibit improved properties, in terms of easiness of taking on and off, fitting property, feeling of wear, dyeing property, resistance to discoloration, appearance-quality or dignity, etc.

The elastic polyurethane yarns of the present invention, with their excellent properties, can yield the excellent stretching fabrics not only singly but also in combination with a variety of miscellaneous yarns, and are suited for weaving, knitting or braid or cord processing work. Specific examples of the application fields where the said elastic polyurethane yarns can be used include a variety of different textile products, such as socks, stockings, circular knitted fabrics, tricots, swimming wears, skiing trousers, working clothes, protective clothes for pyrotechnists, golfing trousers, wet suits, brassieres, girdles, gloves, etc., tightening materials for general purposes, furthermore leak-tight fastening materials for sanitary products, fastening materials for water-proof materials, artificial baits, artificial flowers, electrically insulating materials, wiping fabrics, cleaners for copying machines, gaskets, and the others.

The invention claimed is:

1. An elastic polyurethane yarn made of a polyurethane being composed mainly of a polymeric diol and a diisocyanate, wherein the polyurethane contains through incorporation a compound having within the molecule a phosphorus-nitrogen interatomic bond(s), wherein the compound having within the molecule a phosphorus-nitrogen interatomic bond(s) is at least one selected from the group consisting of hexa(phenoxy)cyclotriphosphazene and octa(phenoxy)cyclotetraphosphazene.

2. The elastic polyurethane yarn according to claim 1, wherein the compound having within the molecule a phosphorus-nitrogen interatomic bond(s) is contained through incorporation at a content of not less than 0.5% by weight but not more than 50% by weight.

3. The elastic polyurethane yarn according to claim 1, wherein the compound having within the molecule a phosphorus-nitrogen interatomic bond(s) is a compound having a molecular weight of not less than 230.

4. The elastic polyurethane yarn according to claim 1, wherein the compound having within the molecule a phosphorus-nitrogen interatomic bond(s) shows a phosphorus content of not less than 5% but not more than 50%.

5. The elastic polyurethane yarn according to claim 1, wherein a circular-knitted fabric of 5 cm in width made by knitting with sole use of the said elastic polyurethane yarn exhibits a self-extinguishing property when subjected to a horizontal combustion test in accordance with the FMVSS-302 Method as set forth in the Federal Motor Vehicle Safety Standard of the U.S.A.

6. A woven or knitted fabric which is made by weaving or knitting with use of the elastic polyurethane yarn according to claim 5.

7. A woven or knitted fabric which is made by weaving or knitting with use of the elastic polyurethane yarn according to claim 1, which is assessed as fire resistant or flame retardant when subjected to the Combustion Test for Materials for Railway Vehicles of Japan.

8. A method of manufacturing an elastic polyurethane yarn according to claim 1, which comprises adding a compound having within the molecule a phosphorus-nitrogen interatomic bond(s) to a solution of a polyurethane composed mainly of a polymeric diol and a diisocyanate, followed by spinning, wherein the compound having within the molecule a phosphorus-nitrogen interatomic bond(s) is at least one selected from the group consisting of hexa(phenoxy)cyclotriphosphazene and octa(phenoxy)cyclotetraphosphazene.

9. An elastic polyurethane yarn made of a polyurethane being composed mainly of a polymeric diol and a diisocyanate, wherein the polyurethane contains through incorporation a compound having within the molecule a phosphorus-nitrogen interatomic bond(s), wherein the compound having within the molecule a phosphorus-nitrogen interatomic bond(s) is methoxy(phenoxy)cyclophosphazene.

10. A method of intensifying chemical resistance of the elastic polyurethane yarn according to claim 1, which comprises adding a compound having within the molecule a phosphorus-nitrogen interatomic bond(s) to a solution of a polyurethane composed mainly of a polymeric diol and a diisocyanate, followed by spinning, wherein the compound having within the molecule a phosphorus-nitrogen interatomic bond(s) is at least one selected from the group consisting of hexa(phenoxy)cyclotriphosphazene and octa(phenoxy)cyclotetraphosphazene.

* * * * *